US007070655B2

(12) United States Patent
Trevisan

(10) Patent No.: US 7,070,655 B2
(45) Date of Patent: Jul. 4, 2006

(54) PRE-TREATMENT TUNNEL AND METHOD OF PREPARING EXTRUSIONS OR SECTION BARS FOR BEING POWDER OR LIQUID COATED

(75) Inventor: Silvio Trevisan, Verona (IT)

(73) Assignee: Trevisan Cometal S.p.A., Verona (IT)

( * ) Notice: Subject to any disclaimer, the term of this patent is extended or adjusted under 35 U.S.C. 154(b) by 8 days.

(21) Appl. No.: 10/293,638

(22) Filed: Nov. 13, 2002

(65) Prior Publication Data

US 2003/0089311 A1 May 15, 2003

(30) Foreign Application Priority Data

Nov. 15, 2001 (IT) ..... VR2001A0120

(51) Int. Cl.
*B05B 7/06* (2006.01)

(52) U.S. Cl. ..... 118/316; 118/602; 118/DIG. 4

(58) Field of Classification Search ..... 118/DIG. 4, 118/324, 72–74, 116, 326, 602, 603, 313–316, 118/410, 411; 134/199, 151, 200, 108; 427/420, 427/424, 327, 345

See application file for complete search history.

(56) References Cited

U.S. PATENT DOCUMENTS

| | | | | | |
|---|---|---|---|---|---|
| 1,592,824 | A | * | 7/1926 | Fairchild | 156/210 |
| 2,742,017 | A | * | 4/1956 | Kennedy | 118/713 |
| 3,011,914 | A | * | 12/1961 | Pflug | 427/335 |
| 3,242,003 | A | | 3/1966 | Brown | |
| 3,383,054 | A | * | 5/1968 | Nugarus | 239/597 |
| 3,662,710 | A | | 5/1972 | Pankoke et al. | |
| 3,793,056 | A | * | 2/1974 | Stease | 427/315 |
| 4,096,298 | A | * | 6/1978 | Menig | 427/262 |
| 4,371,422 | A | * | 2/1983 | Eidschun | 216/13 |
| 4,454,003 | A | * | 6/1984 | Fishman et al. | 216/13 |
| 4,964,365 | A | * | 10/1990 | D'Amato | 118/419 |
| 5,773,094 | A | | 6/1998 | Kruckel | |

FOREIGN PATENT DOCUMENTS

| | | |
|---|---|---|
| FR | 2 668 401 | 4/1992 |

* cited by examiner

*Primary Examiner*—Brenda A. Lamb
(74) *Attorney, Agent, or Firm*—Andrew Wilford

(57) ABSTRACT

Pre-treatment tunnel and method of preparing extrusions or section bars for being coated, wherein each workpiece is caused to move along a pre-treatment path and each treatment liquid is poured from above onto each workpiece so as to spread liquid onto the entire external surface of each workpiece with no solution of continuity.

5 Claims, 3 Drawing Sheets

PRE-TREATMENT TUNNEL AND METHOD OF PREPARING EXTRUSIONS OR SECTION BARS FOR BEING POWDER OR LIQUID COATED

FIELD OF THE INVENTION

The present invention relates to a pre-treatment tunnel and method of preparing extrusions or section bars, e.g. extruded aluminum bars or iron section bars, for a powder or liquid coating process.

BACKGROUND OF THE INVENTION

Currently powder or liquid coating of aluminum-alloy extrusions or iron section bars of considerable length is carried out in suitable automatic continuous treatment plants, in which the workpieces to be treated are moved in a horizontal direction while being suspended in a substantially vertical orientation.

Normally, in such treatment plants a treatment process is carried out which comprises the following sequence of operation steps:

hanging the bars from a chain or chains of a constantly moving overhead chain conveyor at a distance (pitch) between successive bars that varies depending upon the speed of movement of the overhead chain conveyor and the overall dimensions of the workpiece being treated;

pre-treating of the workpieces in a tunnel, where various treatment cycles are carried out in accordance with testing standards which may include, e.g. degreasing, a first washing, deoxidization, a second washing, chromatizing, a third washing, a fourth or final washing with demineralized water;

drying, normally by means of hot air ventilation;

powder or liquid coating in a suitable booth or booths;

final baking, normally by means of hot air ventilation; and unloading of the coated workpieces.

In any case, pre-treatment according to one of its numerous variants in the tunnel is required in order to obtain optimum preparation of the metal surfaces for receiving and permanently holding the coating material thereon, so that a uniform and aesthetically attractive coating is obtained which is waterproof over time.

Actual pre-treatment steps (except washings) carried out in the tunnel involve the use of highly corrosive liquids, which must be kept mostly within preset temperature ranges for predetermined exposure time intervals to obtain optimum results.

Overall pre-treatment action is thus obtained through proper combination of the following parameters: exposure time, temperature, degree of corrosiveness of the liquids and amount of recycled liquid poured onto the surface being treated.

The most used types of pre-treatment are the following:

a) Static Dipping System

This is the oldest system. Pre-treatment liquids are kept almost in a static condition and thus the wetted surface of the workpiece does not come in contact with new liquid, which means that chemical degreasing or detergent action is limited and long exposure times and/or high concentrations of corrosive products are required.

b) Dipping System with Oscillatory Movement of the Workpieces

This dipping system is slightly more effective than the previous one since the workpiece movement, although to a limited extent, promotes renewal of the liquid that comes into contact with the surface of the workpieces. From a practical point of view, this system leads to results that are more or less equivalent to those achievable with the previous system.

c) Spraying System with Flight Manifolds and Nozzles

This is the most common system currently in use because it makes it possible to feed the workpieces and promotes almost continuous change of the liquid wetting the workpiece surface.

The latter system, however, has limitations and drawbacks that will be illustrated with reference to FIGS. 1 and 2 of the accompanying drawings, in which:

FIG. 1 shows a diagrammatic front sectional view of a pre-treatment spraying plant with flight manifolds and nozzles.

FIG. 1*a* is a diagram showing the amount of liquid flowing down along a workpiece, whereas FIG. 2 shows a top view of the plant shown in FIG. 1.

With reference to a pre-treatment tunnel as shown in the above listed Figures, it will be easily noted that each jet G from each of the nozzles U supported by the lateral flight manifolds R affects only a section or length portion of a workpiece P. For this reason, workpieces P do not come in contact with the same amount of sprayed liquid. The amount of liquid running down along each workpiece P being fed throughout the spraying stage increases from top downwards, e.g. as shown in the diagram (amount of liquid A/height B) in FIG. 1*a*.

Thus, each workpiece P is better treated at its lower portion than at its upper portion.

It has already been suggested that this problem can partly be solved by distributing the nozzles U at a non-uniform distance from each other, i.e. a lesser distance at the upper portion and a greater one at its lower portion so as to better balance the distribution of sprayed liquid. This expedient, however, complicates the design and assembling of the tunnel, while still holding that the various sections of the workpieces P in any case will not undergo the action of the same amount of sprayed liquid.

With reference to FIG. 2, it will be noted that the workpieces P are fed in the direction indicated by an arrow F substantially parallel to the two manifolds of nozzles R and thus are not evenly sprayed with liquid by the various jets G while moving through the treatment plant. More particularly, a workpiece $P_1$ is exposed to the jets G, normally of a splayed type, and is thus subjected to a thrust which it is difficult to counteract or balance. At the same time, a workpiece $P_2$ is not at all sprayed by jets G, whereas workpiece $P_3$ is in a similar condition to that of workpiece $P_1$, and so on.

In the areas between two contiguous jets G, such as that in which workpiece $P_2$ is located, the sprays G along the entire height of the manifolds R have very little effect on the workpiece since on one hand they collide with and neutralize each other, and on the other by being located at the edges of the range of action of their respective nozzle their action is far weaker and less effective and thus they promote more formation of mist or vapor rather than having some effect on the workpiece $P_2$ in transit. Accordingly, the workpieces P are effectively treated only at two opposite series of nozzles U (sections $P_1$, $P_3$ $P_5$ . . . ), whereas at their intermediate sections ($P_2$, $P_4$ . . . ) they are treated to a much lesser extent or not at all treated.

This circumstance, which is bound to the design of a spray tunnel with nozzles on fixed manifolds, is responsible for transverse swinging and collisions of the workpieces P, which, in turn, frequently results in the workpieces P tending to rotate about their own axis in a random manner and to swing (pendulum effect) in the feeding direction or in a direction normal to it with frequent collisions, entanglements up to the point in which adjacent workpieces are superimposed on each other, and gluing together phenomena between two or more workpieces P, especially when they have relatively large flat surfaces, with the consequence that two glued-together workpieces are treated at part only of their outer surface.

These phenomena often result also in workpieces P being disengaged and falling off in the treatment tunnel with consequent easily imaginable serious inconveniences, such as plant stoppage, removal of fallen workpieces, repair of plant components in case of damage, replacement of workpieces, and so on. It is therefore necessary that the plant be continuously supervised by operators to avoid production waste or at least reduce it to a minimum.

Another disadvantage of conventional pre-treatment tunnels consists in that the nozzles atomize the treatment liquid when producing jets G, which results in atomization developing along the entire length of the workpiece P. This atomization, especially in the hot sections of the pre-treatment tunnel, inevitably results in random sprays of liquid as well as clouds of mist and vapor being formed inside the pre-treatment tunnel, which inevitably causes treatment liquids to be transferred from one section of the tunnel to the other with consequent contamination of the treatment liquids.

Atomization also promotes dispersion of the heart in the pre-treatment liquids which, at the very least, heats the walls (metal sheets) of the tunnel and the environment to no purpose rather than maintaining the detergent at the temperature required by the pre-treatment liquids themselves. This results in significant heat losses with consequent elevated running costs for the pre-treatment plant. Furthermore, the vapors produced by the atomization are usually polluting for the environment, and must be collected and purified before disposal. Obviously, the supplementary equipment required for separating and/or purifying the atomized drops contribute to further increased plant and running costs.

OBJECTS OF THE INVENTION

The main object of the present invention is to provide a pre-treatment method of, and tunnel for preparing metal workpieces for powder or liquid coating process, suitable for eliminating or drastically reducing the above-mentioned disadvantages which are inherent in conventional pre-treatment systems.

More particularly, it is the object of the present invention to provide a method and a tunnel for pre-treating metal workpieces which, in comparison to the best pre-treatment systems available at the present state of the art, attain the following advantages:

maximum pre-treatment quality at the same exposure times and plant length, significantly reduced production, installation and running costs, elimination of uncontrolled movements of the workpieces during treatment, drastic reduction of the problem of transfer of vapors from one section of the tunnel to another, with consequent elimination of the problems linked to mutual contamination of the pre-treatment liquids, reduction of the running energy costs linked to heat dispersion in the heated zones of the tunnel; and maximum reduction of the problems linked to extraction of polluting vapors.

SUMMARY OF THE INVENTION

According to a first aspect of the present invention, there is provided a pre-treatment method of preparing metal workpieces for a coating process, which includes feeding each workpiece along a pre-treatment path and is characterized in that each treatment liquid is poured uninterruptedly onto each workpiece from above in such a way as to cover the entire external surface of each workpiece.

The following results are attained as an immediate consequence of the above recited method:

each workpiece is covered by the same amount of liquid in an almost uniform manner from its top to its bottom, the amount of liquid poured onto the moving workpiece covers its entire surface, including its interior surface in case of tubular parts, and the refreshment of the liquid on the surface of each workpiece is very high inasmuch as the liquid runs continuously along each workpiece.

These results constitute a decisive improvement in the efficiency of the degreasing-detergent-washing effect of the liquid, its exposure time or flow rate being the same. Furthermore, the action of each liquid on the workpiece is uninterrupted also in the feed direction of the workpiece itself, since each moving workpiece receives the same quantity of liquid starting from its entry into the pre-treatment path to its exit therefrom.

The solution proposed by the present invention thus eliminates all problems connected with splashing characteristic of a conventional spray pre-treatment system.

Any lateral thrust on the workpiece is also eliminated, so that the workpieces do not move in an uncontrolled or anomalous manner during their passage through the pre-treatment path and thus the workpieces do not swing, do not collide with each other, do not rotate around their own axes, do not get stuck together nor fall off the overhead conveyor.

Thanks to continuous flowing of a relatively large quantity of liquid vertically along each workpiece, atomization of the liquid is reduced to a minimum resulting only to a minimum extent and only starting from the moment in which the liquid drips off the bottom of the workpiece into an underlying collection tank. This is a very important feature which eliminates in practice any overflow contamination, drastically reduces heat losses and does away with the need to install expensive separation systems (e.g. partition walls and the like), and extraction and external disposal systems for vapors and fumes.

According to another aspect of the present invention, there is provided a pre-treatment tunnel for carrying out the above described method, the said tunnel including a pre-treatment path for workpieces to be treated, a conveyor extending all along the length of the pre-treatment path and is designed to convey in sequence workpieces suspended therefrom. According to the invention at the tops of the workpieces conveyed by the conveyor a pre-treatment liquid delivering means is provided arranged to continuously supplying pre-treatment liquid which, either by overflowing from or exiting from suitable slits, covers each workpiece and flows down along it from the top to the bottom also by a percolating action, at least one liquid collection tank for the pre-treatment liquid discharged from each workpiece, and a filtering and recycling system for the liquid collected in each collection tank.

Advantageously, the pre-treatment path is delimited by a tunnel structure.

If desired, the conveyor can follow a tortuous path which makes it possible notably to reduce the overall length of the pre-treatment tunnel in comparison to that of conventional pre-treatment tunnels.

BRIEF DESCRIPTION OF THE DRAWING

Further aspects and advantages of the present invention will be better apparent from the following detailed description of a preferred embodiment thereof given by way of illustrative and non-limiting example, the description being made with reference to the accompanying drawing, in which.

SPECIFIC DESCRIPTION

Figure 1:
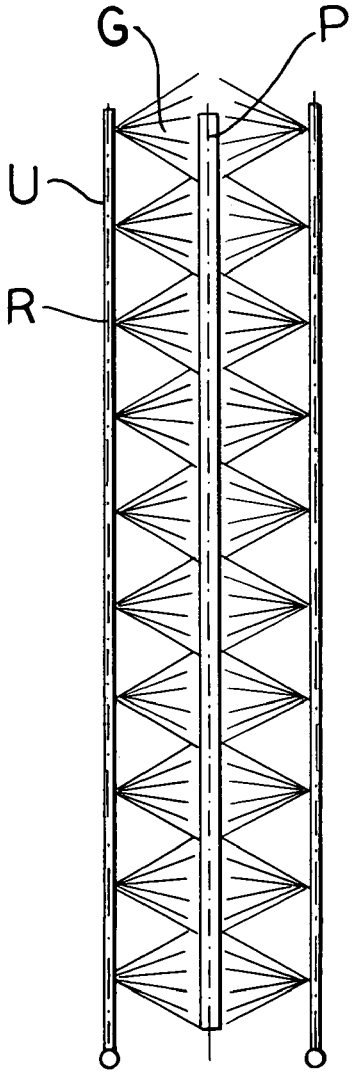
FIG.1 PRIOR ART
FIGS. 1, 1*a* and 2 have been previously described.
Figure 1A:
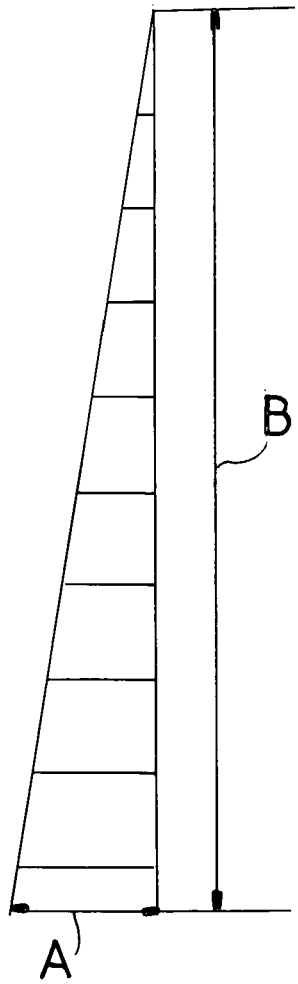
FIG.1a PRIOR ART
Figure 2:
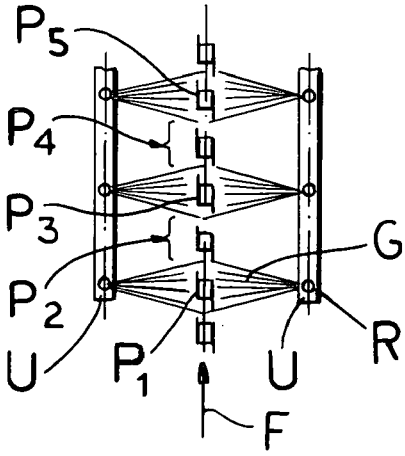
FIG.2 PRIOR ART
Figure 3:
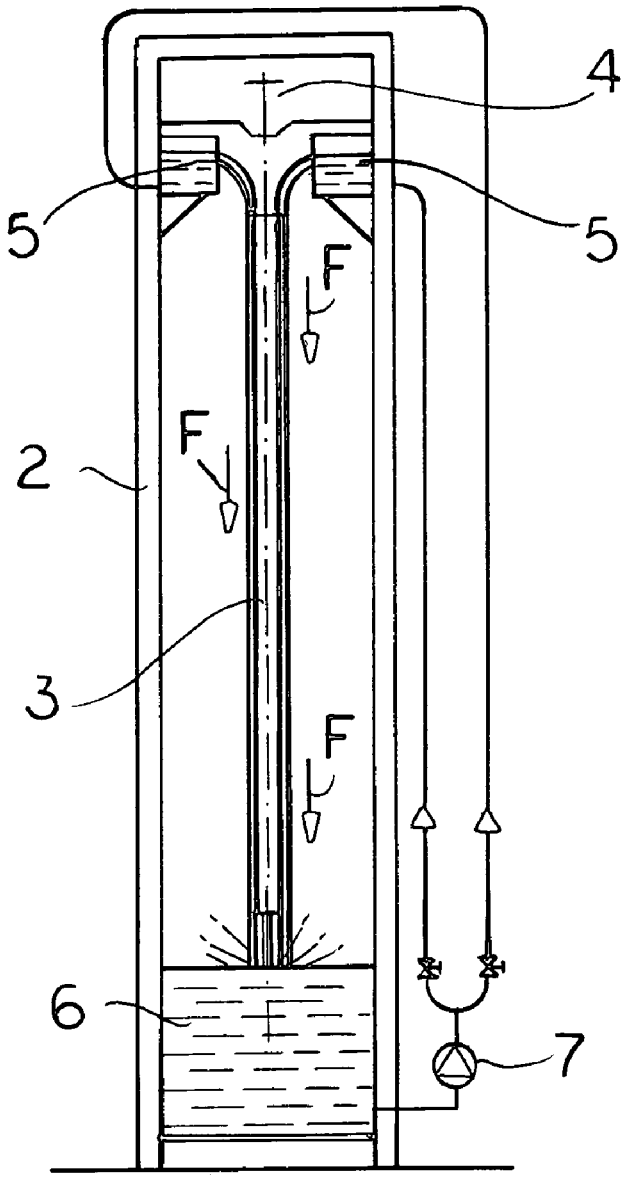
FIG. 3 is a diagrammatic front elevation view of a pre-treatment tunnel according to the present invention.
Figure 4:
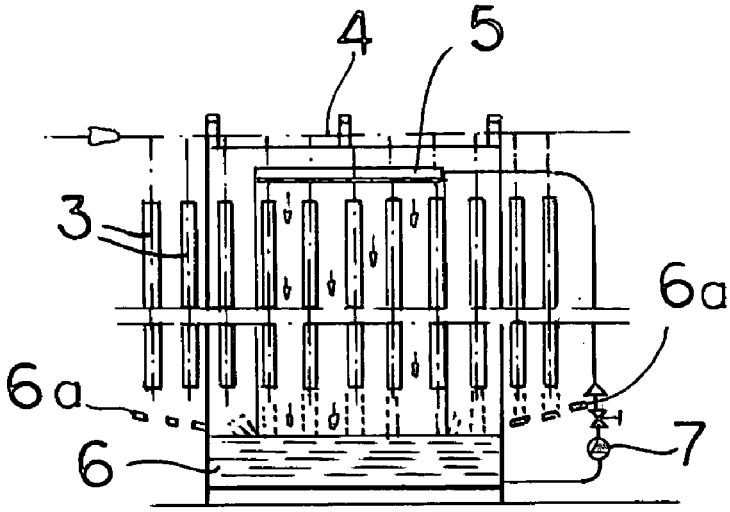
FIG. 4 is a diagrammatic side elevation view of the tunnel of FIG. 3.
Figure 5:
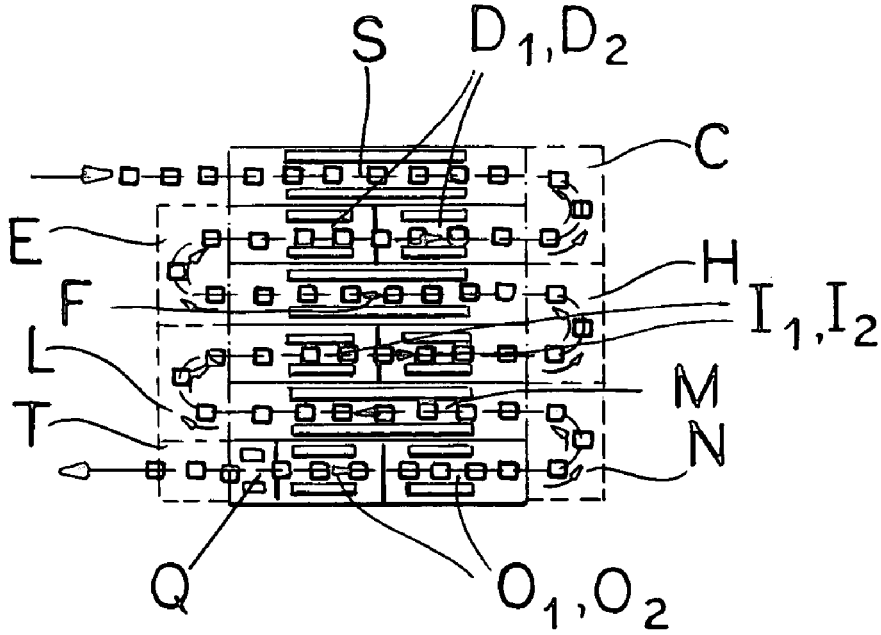
FIG. 5 is a diagrammatic plan view of the tunnel of FIG. 4.

In FIGS. 3 to 5 identical or similar parts or components have been indicated with the same reference numerals.

FIGS. 3 and 4 show a pre-treatment tunnel 1 for carrying out the method according to the present invention, in which one or more tunnel pre-treatment paths 2 are delimited for the workpieces 3 to be pre-treated. An overhead conveyor 4 extends along the entire pre-treatment path 2 and is designed to convey in sequence workpieces 3 suspended from it.

At the tops of the workpieces 3 conveyed by the conveyor 4 are installed two parallel channels 5 arranged to continuously supply, by overflow or exit from suitable slits, pre-treatment liquid at the top of each workpiece 3 conveyed by the conveyor 4. The liquid falling onto the workpiece 3 covers the workpiece itself and runs down it from its top to its bottom, as shown by arrows F in FIG. 3.

At the base of the tunnel 2 there is provided a tank 6 or sequence of tanks 6 for the collection of the pre-treatment liquid discharged from each pre-treated workpiece. A filtering and recycling circuit designed to filter and re-circulate the liquid from each collection tank 6 includes one or more pumps 7, whose deliver is connected to channels for recycling the pre-treatment liquid.

FIG. 5 shows a plan view of an embodiment, in which several parallel sections of tunnel 2 are provided, one outwards and one returning, each of which is designated for a specific pre-treatment operation, while in the curved sections in which the direction of transport is inverted, outside the tunnel sections, the liquid dripping operations takes place. More particularly, section S is dedicated to degreasing, curved section S serves to allow the liquid to drip off the workpieces before the next pre-treatment liquid is applied. In the two straight sections $D_1$ and $D_2$ two successive washes are effected, followed by a section E in which the liquid is allowed to drip off the workpieces before entry into the deoxidizing tunnel F. This is followed by an inversion and dripping curved H followed by two successive washing sections $I_1$ and $I_2$ followed by another dripping section L before entry into a chromatizing tunnel M. on exiting the chromatizing tunnel M the workpiece is allowed to drip off in section N followed by two washes $O_1$ and $O_2$ and a wash with demineralized water in section Q and final dripping off in section T.

The embodiment of tunnel described above has a number of important design advantages which, in turn, translate into considerable production cost savings and reduced overall dimensions compared to conventional spray tunnels.

Above all, it will be noted that the pre-treatment stages S, $D_1$, $D_2$, F, $I_1$, $I_2$, M, $O_1$, $O_2$, Q (FIG. 5) are all located in separate tunnels or chambers, while all dripping off zones or paths C, E, H, L, N, T for recovery of the liquid are equipped with underlying vessel 6*a* for the recovery of the liquid in the tank 6.

If it is then borne in mind that the side walls of the tunnels are made of materials chosen for their high resistance to chemical aggression (e.g. stainless steel) and hence themselves very expensive, the advantages of limiting the closed tunnel-like sections of the plant with intervening open dripping off sections will be very evident.

The fact that the plant has a more or less square in plane view with a highly compact layout, enables the implementation of a pre-treatment tunnel of enormously reduced size compared to that of a conventional spray tunnel. This results in significant space savings as well as reducing investment in plant.

The disclosure in Italian patent application no. VR2001A000120 from which priority is claimed is incorporated herein by reference.

The invention claimed is:

1. A pre-treatment tunnel for preparing metal workpieces for a coating process, comprising:

a pre-treatment path for workpieces located ahead of a coating apparatus;

a overhead conveyor extending along said pre-treatment path and for conveying top-suspended workpieces in sequence in a vertical orientation of the workpieces;

a liquid supply at the tops of the said workpieces, facing opposing surfaces of each workpiece at a level below said overhead conveyor and configured for continuously and repeatedly pouring onto said opposing surfaces a free-falling pre-treatment corrosive liquid that extends liquid-flow along a front directed parallel to a development direction of the said pre-treatment path, that covers entirely said surfaces in an almost uniform manner and percolates from tops of said surfaces to bottoms of said surfaces;

at least one collection tank for pretreatment liquid discharged from each workpiece; and a recycling system designed to re-circulate liquid collected in said collection tank.

2. The tunnel according to claim 1 wherein said liquid supply is constructed and arranged to pour said liquid onto the workpieces by overflow.

3. The tunnel according to claim 1 wherein said liquid supply has at least one slit through which said liquid is poured onto the workpieces.

4. The tunnel according to claim 1 wherein said pre-treatment path is tortuous.

5. The tunnel according to claim 1 wherein said pre-treatment path includes a plurality of pre-treatment stages arranged in separate chambers.

* * * * *